US006086792A

United States Patent [19]

Reid et al.

[11] Patent Number: 6,086,792

[45] Date of Patent: Jul. 11, 2000

[54] CABLE SEMICONDUCTING SHIELDS

[75] Inventors: Charles G. Reid, Millington; Norman M. Burns, Jr., Clinton, both of N.J.

[73] Assignee: Union Carbide Chemicals & Plastics Technology Corporation, Danbury, Conn.

[21] Appl. No.: 09/345,061

[22] Filed: Jun. 30, 1999

[51] Int. Cl.[7] ..... H01B 1/24; H01B 7/17

[52] U.S. Cl. ..... 252/511; 174/102 SC; 174/105 SC; 423/449.1; 524/496

[58] Field of Search ..... 252/511; 174/102 SC, 174/105 SC; 423/449.1; 524/496

[56] References Cited

U.S. PATENT DOCUMENTS

| | | | |
|---|---|---|---|
| 3,401,020 | 9/1968 | Kester et al. | 23/209.4 |
| 3,922,335 | 11/1975 | Jordan et al. | 423/450 |
| 4,246,142 | 1/1981 | Ongchin | 252/511 |
| 4,286,023 | 8/1981 | Ongchin | 428/516 |
| 4,391,789 | 7/1983 | Estopinal | 423/457 |
| 4,608,244 | 8/1986 | Sugihara et al. | 423/445 |
| 4,612,139 | 9/1986 | Kawasaki et al. | 252/511 |
| 5,705,555 | 1/1998 | Guilfoy et al. | 524/495 |

FOREIGN PATENT DOCUMENTS

| | | |
|---|---|---|
| 0420271 | 4/1991 | European Pat. Off. . |
| 60-112204 | 6/1985 | Japan . |

OTHER PUBLICATIONS

Donnet et al., *Carbon Black Science and Technology*, 2nd Ed., Marcel Dekker, New York, 1993, pp. 1 to 66.

Medalia, "Nature of Carbon Black and Its Morphology in Composites," *Carbon Black–Polymer Composites*, ed. By Sichel, publ. By Marcel Dekker, 1982, pp. 1 to 9.

Burns et al., "Stress Controlling Semiconductive Shields in Medium Voltage Power Distribution Cables," *IEEE Electrical Insulation Magazine*, Sep./Oct. 1992, vol. 8, No. 5, pp. 8 to 24.

Probst et al., "New Opportunities with a New Carbon Black Process, " *International Technical Journal for Polymer Materials*, Kautschuk +Gummi–Kunststoffe, Sep. 1993, pp. 707 to 709.

*Primary Examiner*—Mark Kopec
*Attorney, Agent, or Firm*—Saul R. Bresch

[57] ABSTRACT

A semiconducting composition comprising (i) an olefinic polymer and (ii) about 25 to about 45 percent by weight, based on the weight of the composition, of a carbon black having the following properties:

(a) a particle size of at least about 29 nanometers;

(b) a tint strength of less than about 100 percent;

(c) a loss of volatiles at 950 degrees C in a nitrogen atmosphere of less than about 1 weight percent based on the weight of the carbon black;

(d) a DBP oil absorption of about 80 to about 300 cubic centimeters per 100 grams;

(e) a nitrogen surface adsorption area of about 30 to about 300 square meters per gram or an iodine adsorption number of about 30 to about 300 grams per kilogram;

(f) a CTAB surface area of about 30 to about 150 square meters per gram; and (g) a ratio of property (e) to property (f) of greater than about 1.1.

10 Claims, No Drawings

CABLE SEMICONDUCTING SHIELDS

TECHNICAL FIELD

This invention relates to compositions useful in the preparation of power cable semiconducting shields.

BACKGROUND INFORMATION

A typical insulated electric power cable generally comprises one or more high potential conductors in a cable core that is surrounded by several layers of polymeric materials including a first semiconducting shield layer (conductor or strand shield), an insulating layer, a second semiconducting shield layer (insulation shield), a metallic wire or tape shield used as the ground phase, and a protective jacket. Additional layers within this construction such as moisture impervious materials, are often incorporated.

Polymeric semiconducting shields have been utilized in multilayered power cable construction for many decades. Generally, they are used to fabricate solid dielectric power cables rated for voltages greater than 1 kiloVolt. These shields are used to provide layers of intermediate resistivity between the high potential conductor and the primary insulation, and between the primary insulation and the ground or neutral potential. The volume resistivity of these semiconducting materials is typically in the range of $10^{-1}$ to $10^{8}$ ohm-centimeters when measured on a completed power cable construction using the methods described in ICEA (Insulated Cables Engineers Association) specification number S-66-524 (1982), section 6.12, or IEC (International Electrotechnical Commission) specification number contain a polyolefin, conductive carbon black, an antioxidant, and other conventional ingredients such as organic peroxide crosslinking agents, process aids, and performance additives. These compositions are usually prepared in granular or pellet form. Polyolefin formulations such as these are disclosed in U.S. Pat. Nos. 4,286,023; 4,612,139; and 5,556,697; and European Patent 420 271.

The primary purpose of the semiconducting stress control shield between the conductor and insulation within an electrical power cable construction is to ensure the long term viability of the primary solid insulation. The use of extruded semiconducting shields essentially eliminates partial discharge within the cable construction at the interface of conductive and dielectric layers. Longer cable life is also realized through improvement of the conductor shield interfacial smoothness, which then minimizes any localized electrical stress concentration. Polymeric conductor shields with improved smoothness have been demonstrated to extend the cable life through accelerated testing (Burns, Eichhorn, and Reid, IEEE Electrical Insulation Magazine, Vol 8, No. 5, 1992).

A common means to achieve a smooth conductor shield interface is to prepare the semiconducting formulation with acetylene carbon black. Due to the nature of the acetylene carbon black, relative to furnace process carbon black, fewer surface defects are observed on an extruded surface. The primary disadvantage of acetylene black is cost as it is often much more expensive and difficult to manufacture than conventional furnace black.

Furnace carbon blacks are generally easier to use for the manufacture of a semiconducting conductor shield materials. Several commercial carbon black grades described in ASTM D 1765-98b have been used to prepare polymeric semiconductive materials for over forty years, such as N351, N293, N294 (now obsolete), N550, and N472 (now obsolete). However, many of these furnace carbon blacks exhibit poor surface smoothness on the final semiconducting polymeric product.

It is well known that the surface smoothness of an extruded article can be improved by using carbon blacks with larger diameter particles, or, rather, lower surface area. This effect is demonstrated in European Patent 420 271 and Japanese Kokai No. 60-112204.

At the same time, the resistivity of a carbon black based material is related to particle size. That is, larger carbon black particles result in higher, or poorer, resistivity. Hence the two requirements stated here are contradictory requirements. As particle size is increased in order to improve the surface smoothness, the resistivity of the material is increased to an undesirable level.

For a polymeric semiconducting material to be useful for application in an insulated power cable design, the resistivity should be below a fixed value for the product to function correctly. This value is generally stated in power cable specifications, such as IEC specification number 60502 (1996) and AEIC (Association of Edison Illuminating Companies) specification number CS5 (1994), as $10^{5}$ ohm-centimeters maximum at the temperature rating of the cable, generally 90 degrees C for crosslinked polyethylene cable.

Industry is constantly seeking semiconducting formulations, which meet the above requirements and exhibit improved surface smoothness relative to existing commercial carbon black based materials at lower cost.

DISCLOSURE OF THE INVENTION

An object of this invention, therefore, is to provide a composition useful in the preparation of semiconducting shields. This composition will contain a polymeric phase and carbon black, which exhibits improved resistivity and smoothness. Other objects and advantages will become apparent hereinafter.

According to the invention, a semiconducting shield composition has been discovered, which meets the above object. The composition comprises (i) an olefinic polymer and (ii) about 25 to about 45 percent by weight, based on the weight of the composition, of a carbon black having the following properties:

(a) a particle size of at least about 29 nanometers;

(b) a tint strength of less than about 100 percent;

(c) a loss of volatiles at 950 degrees C in a nitrogen atmosphere of less than about 1 weight percent based on the weight of the carbon black;

(d) a DBP oil absorption of about 80 to about 300 cubic centimeters per 100 grams;

(e) a nitrogen surface adsorption area of about 30 to about 300 square meters per gram, or an iodine adsorption number of about 30 to about 300 grams per kilogram;

(f) a CTAB surface area of about 30 to about 150 square meters per gram; and (g) a ratio of property (e) to property (f) of greater than about 1.1.

DESCRIPTION OF THE PREFERRED EMBODIMENT(S)

A good balance of properties in a semiconducting formulation is found through the use of larger particle sized micro-porous carbon blacks. Micro-porous carbon blacks are carbon particles, which exhibit very different surface areas depending upon the method used to determine the surface area. For these carbon blacks, the highest surface area is measured with nitrogen adsorption via ASTM D 3037-93 or D 4820-97 (referred to as NSA or BET). A much lower surface area is measured with a larger probe molecule (such as cetyltrimethyl ammonium bromide) via test method ASTM D 3765-98 (referred to as CTAB).

The ratio of the NSA to CTAB (or similar tests) gives an indication of the degree of porosity present in the carbon black. This is the ratio of property (e) to property (f), referred to above. For the purpose of this disclosure, this ratio will be call the "porosity ratio." A porosity ratio below or equal to unity indicates non-porous particles. A porosity ratio greater than unity is indicative of porosity. A porosity ratio as high as two indicates a very porous carbon black.

A low surface area carbon black, such as ASTM N550 with an NSA of 42 square meter per gram, will vield an improved extruded surface smoothness. However, as will be shown in the examples, more than 42 weight percent of this type of carbon black must be added to a single phase polymer system in order to achieve the resistivity requirements. High concentrations of carbon black result in very poor mechanical properties of the final formulation such as low tensile elongation and higher brittleness temperature. The high resistivity of carbon black ASTM N550 or ASTM N351 was found to be due to the non-porous nature of the carbon black. The carbon blacks used in subject invention have a CTAB surface area similar to N351, but are much more porous.

Porosity of carbon black is usually found in commercial grades of conductive carbon black with CTAB surface areas greater than about 130 square meters per gram and particle sizes smaller than about 29 nanometers. For example, the carbon black, which was described by the ASTM grade N472 (note that, as of 1996, this grade nomenclature is no longer in use), is very electrically conductive; has an arithmetic mean particle size of 22 nanometers; a nominal nitrogen surface area of 270 square meters per gram; and a CTAB surface area of 150 square meters per gram, for a NSA to CTAB ratio of 1.8. This grade exhibits a high degree of porosity, high structure, and smaller particle size, all of which contribute to the lower resistivity of the grade.

As the particle size of carbon blacks is increased, porosity typically decreases and the various measurements of surface area (CTAB, NSA, and Iodine number) converge to the approximately same value. This is true for carbon black grades which have not been treated with a post-reaction oxidation, such as is often done for some commercial grades of carbon blacks used in the ink and pigment industry. It has been the traditional belief in the carbon black industry that porosity is essentially absent in carbon blacks with nitrogen surface areas of less than 130 square meters per gram, as discussed by Avrom I. Medaha in "Nature of Carbon Black and its Morphology in Composites", Chapter 1 in Carbon Black-Polymer Composites, the Physics of Electrically Conducting Composites, editor E. K. Sichel, Marcel Dekker, pages. 6 to 9, 1982. Additional discussion concerning the nearly complete absence of measurable porosity in carbon blacks with iodine surface areas of less than 100 square meters per gram is presented by G. Kuhner and M. Voll in "Manufacture of Carbon Black", Chapter 1 in Carbon Black Science and Technology, $2^{nd}$ Edition, J. B. Donnet, et al, editors, 1993, pages 36 and 37.

This invention is particularly concerned with a semiconducting product prepared from a single phase polymeric system, or a blend of fully miscible polymers. The carbon black used in the system balances the contradictory objectives of smoothness and resistivity. This carbon black yields a semiconducting product with lower resistivity than expected based upon the carbon black properties of surface area and structure.

Resistivity requirements are more difficult to meet in a single phase polymer system, or a blend of fully miscible polymers, than in a blend of immiscible polymers. An immiscible blend is described in U.S. Pat. Nos. 4,286,023 and 4,246,142. In the case of the immiscible blend, the carbon black is concentrated in the more polar of the two (or more) phases, which improves the volume resistivity of bulk material. In a single phase polymer system, the carbon black is equally distributed throughout the polymer phase thereby increasing the mean separation distance between conductive particles.

Semiconducting formulations are prepared by mixing an olefinic polymer with carbon black by conventional means which are well known in the art. Component (i) is an olefinic polymer useful for semiconducting shield compositions. Component (ii) is a carbon black.

Component (i) is any olefinic polymer commonly used in semiconducting shield compositions, such as copolymers of ethylene and unsaturated esters with an ester content of at least about 5 percent by weight based on the weight of the copolymer. The ester content is often as high as 80 percent by weight, and, at these levels, the primary monomer is the ester. The preferred range of ester content is about 10 to about 40 percent by weight. The percent by weight is based on the total weight of the copolymer. Examples of the unsaturated esters are vinyl esters and acrylic and methacrylic acid esters. The ethylene/unsaturated ester copolymers are usually made by conventional high pressure processes. The copolymers can have a density in the range of 0.900 to 0.990 gram per cubic centimeter, and preferably have a density in the range of 0.920 to 0.950 gram per cubic centimeter. The copolymers can also have a melt index in the range of about 1 to about 100 grams per 10 minutes, and preferably have a melt index in the range of about 5 to about 50 grams per 10 minutes. Melt index is determined under ASTM D-1238-95, Condition E, and it is measured at 190 degrees C with a 2160 gram mass.

The ester can have about 4 to about 20 carbon atoms, and preferably has about 4 to about 7 carbon atoms. Examples of vinyl esters are: vinyl acetate; vinyl butyrate; vinyl pivalate; vinyl neononanoate; vinyl neodecanoate; and vinyl 2-ethylhexanoate. Vinyl acetate is preferred.

Examples of acrylic and methacrylic acid esters are: methyl acrylate; ethyl acrylate; t-butyl acrylate; n-butyl acrylate; isopropyl acrylate; hexyl acrylate; decyl acrylate; lauryl acrylate; 2-ethylhexyl acrylate; lauryl methacrylate; myristyl methacrylate; palmityl methacrylate; stearyl methacrylate; 3-methacryloxy-propyltrimethoxysilane; 3-methacryloxypropyltriethoxysilane; cyclohexyl methacrylate; n-hexylmethacrylate; isodecyl methacrylate; 2-methoxyethyl methacrylate: tetrahydrofurfuryl methacrylate; octyl methacrylate; 2-phenoxyethyl methacrylate; isobornyl methacrylate; isooctylmethacrylate; isooctyl methacrylate; and oleyl methacrylate. Methyl acrylate, ethyl acrylate, and n- or t-butyl acrylate are preferred. In the case of alkyl acrylates and methacrylates, the alkyl group can have about 1 to about 8 carbon atoms, and preferably has about 1 to about 4 carbon atoms. As noted above, the alkyl group can be substituted with an oxyalkyltrialkoxysilane, for example.

Other examples of olefinic polymers are: polypropylene; polyiosprene; polybutadiene; EPR (ethylene copolymerized with propylene); EPDM (ethylene copolymerized with propylene and a diene such as hexadiene, dicyclopentadiene, or ethylidene norbornene); copolymers of ethylene and an alpha-olefin having 3 to 20 carbon atoms such as ethylene/octene copolymers; terpolymers of ethylene, alpha-olefin, and a diene (preferably non-conjugated); terpolymers of ethylene, alpha- olefin, and an unsaturated ester; copolymers of ethylene and vinyl-tri-alkyloxy silane; terpolymers of ethylene, vinyl-tri-alkyloxy silane and an unsaturated ester; or copolymers of ethylene and one or more of acrylonitrile or maleic acid esters.

The olefinic polymers useful in subject invention are preferably produced in the gas phase. They can also be produced in the liquid phase in solutions or slurries by conventional techniques. They can be produced by high pressure or low pressure processes. Low pressure processes are typically run at pressures below 7 Mega Pascals (MPa) whereas high pressure processes are typically run at pressures above 100 MPa. Typical catalyst systems, which can be used to prepare these polymers are magnesium/titanium based catalyst systems, which can be exemplified by the catalyst system described in U.S. Pat. No. 4,302,565; vanadium based catalyst systems such as those described in U.S. Pat. Nos. 4,508,842 and 5,332,793; 5,342,907; and 5,410,003; a chromium based catalyst system such as that described in U.S. Pat. No. 4,101,445; a metallocene catalyst system such as that described in U.S. Pat. Nos. 4,937,299 and 5,317,036; or other transition metal catalyst systems. Many of these catalyst systems are often referred to as Ziegler-Natta catalyst systems. Catalyst systems, which use chromium or molybdenum oxides on silica-alumina supports, are also useful. Typical processes for preparing the polymers are also described in the aforementioned patents. Typical in situ polymer blends and processes and catalyst systems for providing same are described in U.S. Pat. Nos. 5,371,145 and 5,405,901. A conventional high pressure process is described in Introduction to Polymer Chemistry, Stille, Wiley and Sons, New York, 1962, pages 149 to 151.

Component (ii) is a carbon black produced via one of several processes well known in the art. The carbon black can be produced by an oil furnace reactor, acetylene black reactor, or other processes. An oil furnace reactor is described in U.S. Pat. Nos. 4,391,789; 3,922,335; and 3,401,020. A process for the production of acetylene carbon black, and carbon black produced by reaction of acetylene and unsaturated hydrocarbons, is described in U.S. Pat. No. 4,340,577. Another process useful for the production of carbon black by the partial oxidation of hydrocarbon oils is described by Probst, Smet and Smet, in Kautschuk and Gummi Kunststoffe, Sept 1993, pages 707 to 709. An extensive compilation of carbon black reactor technologies is presented by G. Kuhner and M. Voll in "Manufacture of Carbon Black", Chapter 1 of Carbon Black Science and Technology, $2^{nd}$ Edition, J. B. Donnet, et al, editors, pages 1 to 66, 1993.

The carbon blacks which are useful in this invention are defined by the combination of several properties which are described in the following details:

The arithmetic mean particle diameter of carbon black is measured with transmission electron microscopy, such as is described in test method ASTM D 3849-95a, Dispersion Procedure D. Most commercial grades of electrically conductive carbon black have mean particle sizes between 18 and 30 nanometers as will be shown in the comparative examples. For this invention, the mean particle size can be at least about 29 nanometers, and the preferred mean particle size is between about 29 and about 70 nanometers.

The tint strength (ASTM D 3265-97) is an indirect measure of particle size distribution. For this invention the tint strength should be less than about 100 percent, with the preferred tint strength being less than about 90 percent.

The volatile content of carbon black is determined by the weight loss of the carbon black when heated under nitrogen to about 950 degrees C. The weight loss at this temperature is a function of the oxygen and hydrogen content of the carbon black. Volatile content will also increase for surface treated carbon blacks. Since increased oxygen functionality interferes with electrical conduction, the volatile loss should be less than about 1 weight percent based on the weight of the carbon black.

The degree of articulation of the carbon black aggregates is measured with an oil absorption test, ASTM D 2414-97, or DBP (dibutyl phthalate absorption number). It is well know to one skilled in the art that resistivity is improved (i.e., decreased) by using carbon blacks with higher DBP numbers. For this invention, the DBP can be in the range of about 80 to 300 cubic centimeters per 100 grams, with a preferred DBP range of about 80 to about 130 cubic centimeters per 100 grams.

Specific surface area by nitrogen gas adsorption is determined by two different methods: ASTM D 3037-93, commonly referred to as NSA single point, and ASTM D 4820-97, commonly referred to as NSA multi-point, or the BET method. These two methods generally agree, but the multi-point method is more precise and is preferred. For this invention, the nitrogen surface area can be in the range of about 30 to about 300 square meters per gram, with a preferred range of about 40 to about 140 square meters per gram.

A commonly used relative measure of surface area used for the production of carbon black is the Iodine Adsorption Number via test method ASTM D 1510-98, and is reported in units of grams per kilogram or milli-equivalents per gram (meq/g). The Iodine Adsorption Number was designed such that the numerical result is approximately equal to the nitrogen surface area of most carbon blacks. The Iodine number is, however, influenced by the surface chemistry of the carbon blacks, and to a lesser extent by the porosity. The carbon blacks investigated in this work have very little surface polarity as evidenced by the low volatiles content, which means that the effects reported are due to the surface porosity. For this invention, the iodine absorption number can be in the range of about 30 to about 300 grams per kilogram, with a preferred range of about 40 to about 140 grams per kilogram.

The CTAB, or cetyltrimethyl ammonium bromide, surface area is obtained by test method ASTM D 3765-98. By measuring the monolayer absorption isotherm for the CTAB molecule, a surface area is derived. The CTAB surface area is independent of surface functional groups on the carbon black particles. CTAB is also not absorbed into the micropores or surface roughness of the carbon black particles. Consequently, the CTAB surface area represents the surface of the carbon black available for interaction with polymer. For this invention, the CTAB surface area can be in the range of about 30 to about 150 square meters per gram, with the preferred CTAB range of about 40 to about 90 to square meters per gram.

Test method ASTM D 5816-96, External Surface Area by Multipoint Nitrogen Adsorption, or Statistical Surface Area (STSA), has become an accepted method to replace the CTAB test ASTM D 3765-98. The difference between the two methods is often very small. The STSA method measures the surface area by excluding micro-pores which are less than 2 nanometers in diameter. This method can be used as an equivalent substitute for CTAB for the carbon blacks useful in this invention.

For electrically conductive grades of carbon black the particle porosity is very important. Porous carbon black particles have been found to result in a semiconducting material with lower resistivity than solid non-porous particles, all other factors being equal. Grades of carbon black which are useful for conductive formulations generally have a high ratio of gas measured surface area (NSA) to liquid measure surface area (CTAB.) For carbon blacks, low volatiles content (less than about 1 percent), the ratio of either the Iodine number, or the nitrogen surface area, to the CTAB surface area provides an indirect measurement of particle porosity. For this invention, the ratio of NSA to CTAB, or Iodine to CTAB, can be greater than about 1.1, and is preferably greater than about 1.3 when the CTAB surface area is less than about 90 square meters per gram.

Carbon blacks useful in this invention can also contain various binders, which are aids that help the preparation of carbon black granules (millimeter size particles) for materials handling systems. Binders often used in the industry are disclosed in U.S. Pat. Nos. 5,725,650 and 5,871,706

Conventional additives, which can be introduced into the semiconducting formulation, are exemplified by, antioxidants, curing agents, crosslinking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators. Additives can be used in amounts ranging from less than about 0.01 to more than about 10 percent by weight based on the weight of the composition.

Examples of antioxidants are as follows, but are not limited to: hindered phenols such as tetrakis[methylene(3, 5-di-tert- butyl-4-hydroxyhydro-cinnamate)] methane; bis [(beta-(3, 5-ditert-butyl-4-hydroxybenzyl)-methylcarboxyethyl)]sulphide, 4,4'-thiobis(2-methyl-6-tert-butylphenol), 4,4'-thiobis(2-tert-butyl-5-methylphenol), 2,2'-thiobis(4-methyl-6-tert-butylphenol), and thiodiethylene bis(3,5-di-tert-butyl-4-hydroxy)hydrocinnamate; phosphites and phosphonites such as tris(2,4-di-tert-butylphenyl) phosphite and di-tert-butylphenyl-phosphonite; thio compounds such as dilaurylthiodipropionate, dimyristylthiodipropionate, and distearylthiodipropionate; various siloxanes; polymerized 2,2,4-trimethyl-1,2-dihydroquinoline, n,n'-bis(1,4-dimethylpentyl-p-phenylenediamine), alkylated diphenylamines, 4, 4'-bis (alpha, alpha-demthylbenzyl)diphenylamine, diphenyl-p-phenylenediamine, mixed di-aryl-p-phenylenediamines, and other hindered amine antidegradants or stabilizers. Antioxidants can be used in amounts of about 0.1 to about 5 percent by weight based on the weight of the composition.

Examples of curing agents are as follows: dicumyl peroxide; bis(alpha-t-butyl peroxyisopropyl)benzene; isopropylcumyl t-butyl peroxide; t-butylcumylperoxide; di-t-butyl peroxide; 2,5-bis(t-butylperoxy)2, 5-dimethylhexane; 2,5-bis(t-butylperoxy)2,5-dimethylhexyne-3; 1,1-bis(t-butylperoxy)3,3,5-trimethylcyclohexane; isopropylcumyl cumylperoxide; di(isopropylcumyl) peroxide; or mixtures thereof. Peroxide curing agents can be used in amounts of about 0.1 to 5 percent by weight based on the weight of the composition. Various other known curing co-agents, boosters, and retarders, can be used, such as triallyl isocyanurate; ethyoxylated bisphenol A dimethacrylate; alpha methyl styrene dimer; and other co-agents described in U.S. Pat. Nos. 5,346,961 and 4,018,852.

Examples of processing aids are as follows: metal salts of carboxylic acids such as zinc stearate or calcium stearate; fatty acids such as stearic acid, oleic acid, or erucic acid; fatty amides such as stearamide, oleamide, erucamide, or n,n'-ethylenebisstearamide; polyethylene wax; oxidized polyethylene wax; polymers of ethylene oxide; copolymers of ethylene oxide and propylene oxide; vegetable waxes; petroleum waxes; non ionic surfactants; and polysiloxanes. Processing aids can be used in amounts of about 0.05 to about 5 percent by weight based on the weight of the composition.

Examples of fillers are as follows: clays, precipitated silica and silicates, fumed silica calcium carbonate, ground minerals, and carbon blacks with arithmetic mean particle sizes larger than 100 nanometers. Fillers can be used in amounts ranging from less than about 0.01 to more than about 50 percent by weight based on the weight of the composition.

Compounding of a semiconducting material can be effected by standard means known to those skilled in the art. Examples of compounding equipment are internal batch mixers, such as a Banbury™ or Bolling™ internal mixer. Alternatively, continuous single, or twin screw, mixers can be used, such as Farrel™ continuous mixer, a Werner and Pfleiderer™ twin screw mixer, or a Buss™ kneading continuous extruder. The type of mixer utilized, and the operating conditions of the mixer, will effect properties of a semiconducting material such as viscosity, volume resistivity, and extruded surface smoothness.

A cable containing the semiconducting shield composition of the invention can be prepared in various types of extruders, e.g., single or twin screw types. A description of a conventional extruder can be found in U.S. Pat. No. 4,857,600. An example of co-extrusion and an extruder therefor can be found in U.S. Pat. No. 5,575,965. A typical extruder has a hopper at its upstream end and a die at its downstream end. The hopper feeds into a barrel, which contains a screw. At the downstream end, between the end of the screw and the die, is a screen pack and a breaker plate. The screw portion of the extruder is considered to be divided up into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of about 15:1 to about 30:1. In wire coating where the polymeric insulation is crosslinked after extrusion, the cable often passes immediately into a heated vulcanization zone downstream of the extrusion die. The heated cure zone can be maintained at a temperature in the range of about 200° C. to about 350° C., preferably in the range of about 170° C. to about 250° C. The heated zone can be heated by pressurized steam, or inductively heated pressurized nitrogen gas. Crosslinking is achieved in this case via the decomposition of organic peroxide.

An alternative means to effect crosslinking can be via the so-called moisture cure systems, i.e., the condensation of alkyloxy silanes which have been copolymerized or grafted to the polymer in the semiconductive composition.

There are several advantages provided by this invention. One is the ability to utilize coarser, or larger particle size, carbon blacks in the composition of an extrudable semiconducting material, and still meet the processing and resistivity requirements for commercial formulations used as conductor shields in insulated power cables. Another is that lower surface area carbon blacks improve the extruded smoothness, and reduce the cost of the semiconducting material. This invention avoids the problem of excessively high volume resistivity at 90 or 130 degrees C when carbon blacks such as ASTM N550 are used at concentrations of less than about 40 percent by weight, based on the weight of the composition, in a single phase polymer system. This invention also avoids the high viscosity of the polymer composition caused by carbon blacks with low surface area and high DBP structure, such as ASTM N351.

The invention also has an advantage of cost. The productivity of carbon black in an oil furnace process is improved with lower surface area. The cost of a carbon black is often directly proportional to the Iodine number of the grade. Consequently, a semiconductive product which is prepared from a carbon black with lower surface area will have lower cost.

The term "surrounded" as it applies to a substrate being surrounded by an insulating composition, jacketing material, semiconducting shield, or other cable layer is considered to include extruding around the substrate; coating the substrate; or wrapping around the substrate as is well known by those skilled in the art. The substrate can include, for example, a core including a conductor or a bundle of conductors, or various underlying cable layers as noted above.

All molecular weights mentioned in this specification are weight average molecular weights unless otherwise designated.

The patents and other publications mentioned in this specification are incorporated by reference herein.

The invention is illustrated by the following examples.

EXAMPLES

A conventional method for measuring volume resistivity of extrudable semiconducting materials is to compression mold and cure a slab of product, and then measure the volume resistivity by means of parallel electrodes applied with conductive paint. This method is derived from the methods described in ASTM D 991-89 and ASTM D 4496-93. The compression mold methods, however, do not take into account the effects of processing history on the semiconducting material. For the case of extruded semiconducting shields used on 15 kilo Volt (kV) cables, a screw extruder is utilized to pump the product through a screen pack and then through a wire coating die. Crosslinkable materials are then passed immediately into a constant vulcanization tube. Each of these processing steps effects the volume resistivity of the extruded shield, generally adversely. The mechanical shearing of carbon black aggregate structures during the extrusion process generally causes an increase in the apparent volume resistivity of these materials by one to three orders of magnitude higher that that measured on stress relieved compression molded slabs.

In order to better simulate the adverse effects of extrusion upon the volume resistivity, a laboratory method was developed to simulate full size power cable extrusion. This method utilizes a 20 millimeter laboratory extruder to apply a concentric layer of semiconducting composition over a wire insulated with standard crosslinkable polyethylene insulation. The two layer coated wire is then used as is, or it may be cured in a static vertical steam chamber if peroxide has been added to the materials.

The dimensions of this miniature construction are as follows: copper wire AWG (American Wire Gauge) number 14 (2 square millimeters cross sectional area), insulation of crosslinkable polyethylene (such as Union Carbide™ HFDE-4201) applied to a thickness of 2.0 millimeters, and then a semiconductive concentric outermost layer of 0.7 to 0.9 millimeter thick. The insulation and semiconducting layers are applied in separate extrusion operations. The insulation is applied with a single layer wire coating die fed by a 64 millimeter 20:1 length to diameter polyethylene extruder. The semiconducting layer is applied with a single layer wire coating die fed by a 20 millimeter 20:1 length to diameter laboratory extruder. The cross sectional area of the outer semiconducting annulus layer on the completed cable is approximately 10 to 20 square millimeters.

Measurement of volume resistivity of the semiconducting layer on this miniature cable construction is performed in a manner very similar to the method described for insulation shield volume resistivity in the specifications ICEA S-66-524 (1982), section 6.12, or IEC 60502-2 (1997), Annex C. These methods do not measure the true volume resistivity, but instead measure a property which is a combination of the surface and volume resistivities. The geometry of the miniature construction described here is very similar to the geometry of full-scale extruded solid dielectric power cables.

Circumferential electrodes are applied directly to the outer surface of the semiconducting layer with high temperature rated silver based paint (for example, DuPont™ grade 4817N). The electrodes are about 10 millimeters wide and are separated by approximately 100 millimeters. After the silver electrodes have cured, copper wires (18 to 20 AWG) are then wound helically around the electrodes several times, and the wire ends collected together perpendicular to the length of miniature cable. The copper wires are then painted with the silver paint to ensure good electrical contact between the copper wires and the underlying silver electrode which has been painted onto the semiconductive layer. The ohm-meter sensor wires are then connected directly to the copper wires on the sample. The use of silver conductive paint is required to minimize the electrode contact resistance for the sample.

The samples are then placed in a heated oven at 90 to 130 degrees C with appropriate test leads feeding into the oven. Resistance of the sample is measured with a standard commercial two wire DC ohm meter. For typical semiconducting materials, the resistance of the sample is 1 to 1,000 kilo-ohms, which is much higher than the sensing circuit and justifies the use of a two wire test circuit instead of four wires.

The volume resistivity of semiconducting materials measured with this method agrees quite well to generally within one order of magnitude of the values obtained for identical semiconducting materials on 15 kiloVolt crosslinked polyethylene cable designs with conductor sizes of AWG number 2 (34 square millimeters) or 1/0 (54 square millimeters).

The following Table 1 is a compilation of various carbon blacks (described by their properties), which will be used in the examples.

TABLE 1

Carbon Black Properties

| Carbon Black | Particle Size (nm) | Tint (%) | DBP ($cm^3$/100 g) | NSA ($m^2$/g) | Iodine (g/kg) | CTAB ($m^2$/g) | Iodine:CTAB ratio | NSA:CTAB ratio |
|---|---|---|---|---|---|---|---|---|
| Comp CB 1 | 28 | 86 | 115 | 156 | 174 | 97 | 1.8 | 1.6 |
| Comp CB 2 | 20 | 92 | 116 | 156 | 172 | 104 | 1.7 | 1.5 |
| Comp CB 3 | 30 | 90 | 111 | 135 | 157 | 92 | 1.7 | 1.5 |
| Comp CB 4 | 20 | 125 | 114 | 123 | 135 | 110 | 1.2 | 1.1 |
| Comp CB 5 | 20 | 103 | 94 | 112 | 122 | 107 | 1.0 | 1.0 |
| Comp CB 6 | 27 | 77 | 123 | 56 | 65 | 60 | 1.1 | 0.9 |
| Comp CB 7 | 62 | 55 | 121 | 40 | 43 | 40 | 1.1 | 1.0 |
| Comp CB 8 | 29 | 83 | 77 | 62 | 73 | 57 | 1.3 | 1.1 |
| CB-1 | 30 | 86 | 99 | 101 | 127 | 77 | 1.6 | 1.3 |
| CB-2 | 31 | 90 | 84 | 114 | 125 | 78 | 1.6 | 1.5 |
| CB-3 | 31 | 78 | 99 | 62 | 74 | 55 | 1.3 | 1.1 |
| CB-4 | 31 | 85 | 88 | 87 | 99 | 64 | 1.5 | 1.4 |
| CB-5 | 31 | 75 | 99 | 107 | 122 | 62 | 2.0 | 1.7 |
| CB-6 | 30 | 76 | 115 | 122 | 138 | 71 | 1.9 | 1.7 |

The comparative carbon black grades, numbers Comp CB 1 to Comp CB 7, are commercially available products, which are useful in semiconducting formulations. Comparative carbon blacks 1 through 3 are generally recognized as highly conductive carbon blacks. Comparative carbon black Comp CB 8 is an experimental product. Carbon black numbers CB-1 through CB-6 are experimental grades useful for the invention described here. Comparative carbon black 4 is an ASTM N110 type. Comparative carbon black 6 is very similar to ASTM N351 except for the tint, which is much lower than the ASTM N351 specification. Comparative carbon black 7 is similar to an ASTM N550 type.

The volatiles content for all comparative and experimental carbon blacks is less than 1 percent, which indicates very little surface polarity for these carbon blacks.

Carbon blacks CB-1 through CB-6 are all produced on various commercial scale oil furnace carbon black reactors. The five carbon blacks, CB-1 through CB-4, and Comp CB 8, represent a simple two level design of experiments with high and low values of Iodine and DBP, and a center point. Carbon blacks CB-5 and CB-6 have exceptionally high micro-porosity represented by the porosity ratios NSA:CTAB, or Iodine:CTAB, which are much higher than 1.3, while also having CTAB surface areas less than 80 square meters per gram.

EXAMPLES 1 to 14

These examples involve semiconducting polyolefin compositions prepared with a 270 cubic centimeter batch laboratory mixer. The polymer that is used to prepare these examples is an ethylene-ethyl acrylate copolymer with 18 weight percent ethyl acrylate comonomer and a 20 decigrams per minute melt index. Polymerized 2,2,4-trimethyl-1,2-dihydroquinoline antioxidant is added to these compositions as the antioxidant. After mixing, the samples are tested for carbon black content, viscosity, and volume resistivity. Surface smoothness on these samples is not evaluated due to the poor dispersive mixing achieved in this type of laboratory mixer.

Carbon black content is determined for these compositions by weight loss at 650 degrees C under nitrogen. Three samples of the composition, one gram each, are tested with a large capacity thermogravimetric analyzer. The carbon black content is recorded after the weight loss reached stability under isothermal conditions.

Viscosity is measured with a laboratory capillary rheometer, Gottfert™ Rheograph model 2001. Test temperature is 125 degrees C, capillary dimensions are 1 by 20 millimeters. The apparent shear rate for the measurements reported here is 360 $sec^{-1}$. The apparent shear viscosity is reported, which is calculated directly from the pressure drop across the capillary with no end correction. Most commercially available semiconducting materials exhibit apparent shear viscosity in the range of 1200 to 1600 Pascal seconds (Pa-sec) at 360 $sec^{-1}$ when measured with this method, similar to what is observed with Examples 1 and 2. and as will be shown in further examples.

Volume resistivity of these samples is measured in the thermoplastic state without curing agents using the miniature cable construction described earlier. The cables are measured at 90 degrees C in a forced air oven after 7 days of exposure. Variables and results for examples 1 to 14 are set forth in Table 2.

TABLE 2

Examples 1 to 14

| Ex No. | Carbon Black Type | CB weight percent | Volume Resistivity 90° C., 7 days (ohm-cm) | Viscosity at 125° C. (Pa-sec) |
|---|---|---|---|---|
| 1 | Comp CB 1 | 36.2 | 8,900 | 1,160 |
| 2 | Comp CB 1 | 42.3 | 640 | 1,680 |
| 3 | Comp CB 4 | 38.8 | 1,600 | 1,520 |
| 4 | Comp CB 7 | 40.2 | 33,000 | 1,570 |
| 5 | CB-1 | 35.8 | 42,000 | 979 |
| 6 | CB-1 | 42.0 | 2,900 | 1,390 |
| 7 | CB-2 | 35.8 | 21,000 | 874 |
| 8 | CB-2 | 41.9 | 1,800 | 1,190 |
| 9 | CB-3 | 35.8 | 10,000 | 1,010 |
| 10 | CB-3 | 41.7 | 4,600 | 1,380 |
| 11 | Comp CB 8 | 35.5 | 290,000 | 880 |
| 12 | Comp CB 8 | 41.4 | 25,000 | 1,150 |
| 13 | CB-4 | 135.7 | 110,000 | 879 |
| 14 | CB-4 | 41.8 | 5,700 | 1,250 |

Variables 1 to 4 are comparative formulations with commercially able carbon black. These examples show the typical range for e resistivity and viscosity of polyolefin semiconducting materials prepared with a laboratory batch mixer. Examples 3 through 14 are intended to demonstrate the limits of acceptable combinations of the key carbon black properties CTAB, DBP, and porosity to meet volume resistivity requirements.

Volume resistivity is a property which behaves logarithmically with linear changes in carbon black content in the range being studied here. An increase in carbon black content will reduce volume resistivity. Volume resistivity values greater than 10,000 ohm-cm at 90 degrees C after 7 days are unacceptable for materials prepared with a laboratory batch mixer and tested with this method. This value is only a factor of 10 below the cable specifications of 100,000 ohm-cm maximum. Most commercially produced semiconducting materials exhibit volume resistivity in the range of 100 to 5,000 ohm-cm using this test method, such as observed with Examples 1 and 2, and as will be shown in further examples.

In the single phase polymer system used here, if the volume resistivity is greater than 10,000 ohm-cm with a carbon black loading of 42 weight percent, then the carbon black is not appropriate for this application. More carbon black can be added, but the mechanical properties with higher carbon black loading are not acceptable to the application. As more carbon is added to an extruded semiconducting shield, the material becomes more brittle which results in mechanical cracking during service, and ultimately failure of the power cable due to corona discharge at the site of the crack in the semiconducting resistive shield.

Example 3 demonstrates that a fine particle carbon black (particle size of 20 nanometers) can be used to prepare a composition with acceptable volume resistivity and viscosity. However, as will be shown in further examples, the surface smoothness of semiconductive shields prepared from ASTM N110 type carbon blacks is generally very poor.

Example 4 shows that volume resistivity is unacceptable for a composition prepared from comparative carbon black number 7, which is an ASTM N550 type. Even though this carbon black has a DBP of 121 cubic centimeters per 100 grams, this is not high enough to overcome the adverse effect of the lower surface area of 40 square metes per gram which reduces volume resistivity in this semiconductive polyolefin composition. This carbon black has effectively no porosity as indicated by the porosity index near unity in Table 1.

Examples 5 through 14 demonstrate that a micro-porous carbon black with a porosity index of 1.1, or higher, can be utilized to produce a semiconductive polyolefin with the combination of CTAB greater than 55 and DBP greater than 99, or the combination of CTAB greater than 64 and DBP greater than 88.

Examples 7 and 8, prepared with CB-2, demonstrate that an acceptable semiconducting composition can be prepared with a porous carbon black that has a CTAB of 78 square metes per gram and a DBP of 84 cubic centimeters per 100 grams.

Examples 9 and 10 demonstrate that a semiconducting composition prepared from CB-3 shows improved properties as a consequence of the higher DBP of 99 cubic centimeters per 100 grams, with a low CTAB of 55 square metes per gram. Examples 11 and 12 demonstrate that the volume resistivity requirement cannot be met with a composition prepared from carbon black Comp CB 8, which is very similar to CB-3 except for lower DBP. The volume resistivity of the composition in Example 12 with 41 weight percent carbon black is 25,000 ohm-cm, much higher than the requirement of 10,000 ohm-cm maximum. This is due to the combination of low CTAB surface area of 57 square meters per gram and DBP of 77 cubic centimeters per 100 grams for carbon black.

Examples 13 and 14, prepared with carbon black CB-4, demonstrate that a porous carbon black with CTAB of 64 square metes per gram with DBP of 88 cubic centimeters per 100 grams can be used to prepare a composition which meets the volume resistivity requirements. The volume resistivity of the composition at a loading of 41.8 weight percent of CB-4 is well within the requirement of 10,000 ohm-cm maximum.

EXAMPLES 15 to 21

Examples 15 to 21 are concerned with compositions prepared with a commercial scale continuous compounding machine, a 140 mm Buss™ Co-Kneader extruder. The polyolefin used to prepare these examples is an ethylene/ethyl acrylate copolymer with 18 weight percent ethyl acrylate co-monomer and a 20 decigrams per minute melt index. Polymerized 2,2,4-trimethyl-1,2-dihydroquinoline antioxidant is added to these compositions as the antioxidant. After mixing, the samples are tested for carbon black content, viscosity, volume resistivity, and extruded surface smoothness.

Surface smoothness of these samples is evaluated with a laser based device, originally sold as Uninop-S™ by Svante Björk AB, Sweden. This instrument is able to measure the height of surface defects on an extruded ribbon of semiconductive material. The extruded ribbon is approximately 70×0.8 millimeter in cross section. The instrument inspects approximately a 10 millimeter wide strip in the center of the extruded ribbon. Surface defects with a height greater than 25 microns (um), relative to the mean horizon of the extruded ribbon, are detected and counted with a laser based optical system. Approximately 0.8 square meter of surface area are analyzed per sample. The defect counts from this instrument are then grouped by size and normalized to the number per square meter.

Variables and results for examples 15 to 21 are set forth in Table 3.

TABLE 3

| | | | Examples 15 to 21 | | | | |
|---|---|---|---|---|---|---|---|
| | | | Volume Resistivity | | Surface Smoothness (defect height) | | |
| Ex No. | CB Type | CB weight percent | 90° C., 7 days (ohm-cm) | Viscosity 125° C. (Pa-sec) | 25–34 um (No/m$^2$) | 35–44 um (No/m$^2$) | >45 um (No/m$^2$) |
| 15 | Comp CB 1 | 37.5% | 1,500 | 1,400 | 9 | 2.1 | <1.0 |
| 16 | Comp CB 2 | 38.3% | 750 | 1,590 | 31 | 1.5 | <1.5 |
| 17 | Comp CB 3 | 39.9% | 1,700 | 1,650 | <1.5 | 1.5 | <1.5 |
| 18 | Comp CB 5 | 36.9% | 2,000 | 1,340 | 308 | 33.5 | 10.4 |

TABLE 3-continued

| Examples 15 to 21 | | | | | | | |
|---|---|---|---|---|---|---|---|
| | | | Volume Resistivity | | Surface Smoothness (defect height) | | |
| Ex No. | CB Type | CB weight percent | 90° C., 7 days (ohm-cm) | Viscosity 125° C. (Pa-sec) | 25–34 um (No/m$^2$) | 35–44 um (No/m$^2$) | >45 um (No/m$^2$) |
| 19 | CB-5 | 39.6% | 3,100 | 1,400 | <1.5 | <1.5 | <1.5 |
| 20 | CB-6 | 36.5% | 5,100 | 1,320 | n/a | n/a | n/a |
| 21 | CB-6 | 38.8% | 1,700 | 1,500 | <1.5 | <1.5 | <1.5 |

Examples 15, 16, and 17 are representative of commercial grades of semiconducting conductor shield compounds. The volume resistivity, viscosity, and surface smoothness for these materials is typical for commercial semiconducting compositions prepared from furnace carbon blacks. Similar to the previous set of examples, the volume resistivity should be less than 10,000 ohm-cm at 90 degrees C. Viscosity for the commercial semiconducting materials should be between 1200 and 1600 Pascal seconds with these test conditions.

The poorer surface smoothness of Example 16 in the 25 to 34 micron range is a consequence of both the smaller particle size and higher tint of comparative carbon black number 2 relative to comparative carbon blacks numbered 1 and 3.

Example 18 is a comparative composition utilizing carbon black with nitrogen surface area and iodine number similar to the compositions with the preferred carbon blacks. However, comparative carbon black 5, which is used here, has a higher CTAB surface area consistent with a non porous particle. As expected, the volume resistivity of Example 18 is similar to the comparative examples 15 and 16, due to the smaller mean particle size, comparable surface area, and comparable DBP. Consistent with the higher tint, higher CTAB, and smaller particle size, the surface smoothness of example 18 is much poorer.

Examples 19 through 21 are compositions prepared with carbon blacks that have high porosity and larger particle size. These systems show improved surface smoothness relative to comparative examples 15, 16, and 18. The volume resistivity of examples 19 to 21 is slightly higher than comparative examples 15 to 17, but still well within the acceptable range of 10,000 ohm-cm maximum. The viscosity of examples 19 to 21 is lower than comparative examples 15, 16, and 18, at equivalent carbon black content, which is very advantageous for improved extrudability of the composition.

EXAMPLES 22 to 24

Examples 22 to 24 are compositions prepared with a commercial scale continuous compounding machine in an identical manner described for Examples 15 to 21. The polyolefin and antioxidant used to prepare these examples is identical to that used in examples 1 to 21.

Carbon black Comp CB 6, used to prepare compositions in Examples 22 and 23, is a commercially available carbon black that is often utilized for the preparation of semiconducting formulations for power cables shields.

Example 24 is an embodiment of the invention. Both carbon blacks Comp CB 6 and CB-5 have approximately the same CTAB surface area of 60 square meters per gram. Carbon black Comp CB 6 has a DBP of 123 cubic centimeters per 100 grams whereas CB-5 has a DBP of 99 cubic centimeters per 100 grams. The Carbon black CB-5 has the advantage of being micro-porous relative to Comp CB 6.

Variables and results for examples 22 to 24 are set forth in Table 4.

TABLE 4

| Examples 22 to 24 | | | | | | | |
|---|---|---|---|---|---|---|---|
| | | | Volume Resistivity | | Surface Smoothness (defect height) | | |
| Ex No. | CB Type | CB weight percent | 90° C., 7 days (ohm-cm) | Viscosity 125° C. (Pa-sec) | 25–34 um (No/m$^2$) | 35–44 um (No/m$^2$) | >45 um (No/m$^2$) |
| 22 | Comp CB 6 | 38.2% | 8,600 | 1,680 | <1.5 | <1.5 | <1.5 |
| 23 | Comp CB 6 | 41.8% | 470 | 2,130 | n/a | n/a | n/a |
| 24 | CB-5 | 39.60% | 3,100 | 1,400 | <1.5 | <1.5 | <1.5 |

Examples 22 and 23 demonstrate that the carbon black Comp CB 6 can be used to produce a semiconducting composition with a single polymer phase that has a volume resistivity below 10,000 ohm-cm at 90 degrees C. Since this carbon black is non-porous, the volume resistivity is achieved through the high value of DBP, similar to what is shown in Examples 9 and 10. However, the high value of DBP causes an adverse effect upon viscosity which is near 1,700 Pa-sec at a concentration of 38 weight percent within the composition. The low tint value of 77 percent, and lower CTAB, for Comp CB 6 are most likely responsible for the very good surface smoothness of example 22.

Example 24 demonstrates an advantage of the invention where a porous carbon black CB-5, with identical CTAB surface area to Comp CB 6, can be used to obtain appropriate volume resistivity and lower viscosity at the same time. This composition exhibits volume resistivity similar to the compositions in examples 22 and 23 when corrected for the differences in carbon black content. However, the viscosity of Example 24 is much lower than Example 22, even though there is about 4 percent more carbon black in Example 24. Since the DBP of CB-5 is 99 cubic centimeters per 100 grams, much lower than Comp CB 6, the acceptable volume resistivity of Example 24 is achieved by virtue of the high micro-porosity of the carbon black.

Notes to Examples:

nm=nanometer n/a=not available

Pa-sec=Pascal seconds

CB=carbon black um=micro meters

No/m$^2$=number per square meter (area densitv)

Viscosity for all examples is measured at 125 degrees C, 360 1/s apparent shear rate, 1×20 mm capillary.

Volume resistivity for all examples is measured with the method described herein.

What is claimed is:

1. A semiconducting composition comprising (i) an olefinic polymer and (ii) about 25 to about 45 percent by weight, based on the weight of the composition, of a carbon black having the following properties:

(a) a particle size of at least about 29 nanometers;

(b) a tint strength of less than about 100 percent;

(c) a loss of volatiles at 950 degrees C in a nitrogen atmosphere of less than about 1 weight percent based on the weight of the carbon black;

(d) a DBP oil absorption of about 80 to about 300 cubic centimeters per 100 grams;

(e) a nitrogen surface adsorption area of about 30 to about 300 square meters per gram or an iodine adsorption number of about 30 to about 300 grams per kilogram;

(f) a CTAB surface area of about 30 to about 150 square meters per gram; and (g) a ratio of property (e) to property (f) of greater than about 1.1.

2. The composition defined in claim 1 wherein the carbon black is present in an amount about 25 to about 42 percent by weight, based on the weight of the composition, and has the following properties:

(a) a particle size of about 29 to about 70 nanometers;

(b) a tint strength of less than about 90 percent;

(c) a loss of volatiles at 950 degrees C in a nitrogen atmosphere of less than about 1 weight percent based on the weight of the carbon black;

(d) a DBP oil absorption of about 80 to about 130 cubic centimeters per 100 grams;

(e) a nitrogen surface adsorption area of about 40 to about 140 square meters per gram or an iodine adsorption number of about 40 to about 140 grams per kilogram;

(f) a CTAB surface area of about 40 to about 90 square meters per gram; and (g) a ratio of property (e) to property (f) of greater than about 1.3.

3. The composition defined in claim 1 wherein the polymer is a copolymer of ethylene and one or more alpha olefins, the alpha olefins being present in the copolymer in an amount of about 0.1 to about 50 percent by weight based on the weight of the copolymer.

4. The composition defined in claim 1 wherein the polymer is a copolymer of ethylene and an unsaturated ester selected from the group consisting of vinyl esters, acrylic acid esters, and methacrylic acid esters, the ester being present in the copolymer in an amount of about 5 to about 60 percent by weight based on the weight of the copolymer.

5. The composition defined in claim 1 wherein the polymer is a terpolymer of ethylene, an alpha olefin, and an unsaturated ester selected from the group consisting of vinyl esters, acrylic acid esters, and methacrylic acid esters, the ester being present in the copolymer in an amount of about 5 to about 60 percent by weight based on the weight of the terpolymer.

6. The composition defined in claim 1 wherein the polymeric olefin is a blend of one or more miscible polymeric olefins.

7. The composition defined in claim 1 wherein the polymeric olefin is a blend of a polyolefin and a butadiene/acrylonitrile copolymer containing about 10 to about 50 percent by weight acrylonitrile based on the weight of the copolymer.

8. The composition defined in claim 1 in a crosslinked state.

9. The composition defined in claim 1 which exhibits a volume resistivity of less than 10,000 ohm-centimeters at 90 degrees C after 7 days exposure.

10. A cable comprising one or more electrical conductors or a core of electrical conductors, each conductor or core being surrounded by at least one layer comprising the composition defined in claim 1.

* * * * *